US009109432B2

(12) United States Patent
Hansen et al.

(10) Patent No.: US 9,109,432 B2
(45) Date of Patent: Aug. 18, 2015

(54) HYDRAULIC SCREEN TABLE APPARATUS

(75) Inventors: Cody Hansen, Broussard, LA (US); Jed Landry, Breaux Bridge, LA (US); Tommy Hebert, Houma, LA (US); Wayne Cancienne, Houma, LA (US)

(73) Assignee: CONCENTRIC PIPE AND TOOL RENTALS, L.L.C., Houma, LA (US)

( * ) Notice: Subject to any disclaimer, the term of this patent is extended or adjusted under 35 U.S.C. 154(b) by 371 days.

(21) Appl. No.: 13/549,070

(22) Filed: Jul. 13, 2012

(65) Prior Publication Data

US 2014/0014319 A1 Jan. 16, 2014

(51) Int. Cl.

| | |
|---|---|
| ***E21B 19/16*** | (2006.01) |
| ***E21B 43/10*** | (2006.01) |
| ***E21B 19/06*** | (2006.01) |
| ***E21B 19/08*** | (2006.01) |

(52) U.S. Cl.

CPC ..... *E21B 43/10* (2013.01); *E21B 19/06* (2013.01); *E21B 19/08* (2013.01)

(58) Field of Classification Search

CPC ..... E21B 19/00; E21B 19/086
USPC ..... 166/77.51, 250.01, 380, 382, 77.52, 166/85.1, 85.4, 78.1
See application file for complete search history.

(56) References Cited

U.S. PATENT DOCUMENTS

| | | | | |
|---|---|---|---|---|
| 3,454,289 | A | 7/1969 | Fowler | |
| 4,595,062 | A * | 6/1986 | Boyadjieff et al. | 166/379 |
| 6,053,250 | A | 4/2000 | Echols | |
| 6,206,096 | B1 * | 3/2001 | Belik | 166/77.51 |
| 6,598,685 | B1 | 7/2003 | Mashburn | |
| 6,793,020 | B2 | 9/2004 | Courts | |
| 6,793,021 | B1 | 9/2004 | Fanguy | |
| 7,055,609 | B2 | 6/2006 | Hayes et al. | |
| 7,117,938 | B2 * | 10/2006 | Hamilton et al. | 166/77.53 |
| 7,243,742 | B2 | 7/2007 | Kutryk | |
| 8,640,767 | B2 * | 2/2014 | Tucken | 166/77.4 |
| 2008/0066928 | A1 * | 3/2008 | Thomas et al. | 166/380 |
| 2008/0236841 | A1 | 10/2008 | Howlett et al. | |
| 2011/0315369 | A1 | 12/2011 | Holderman et al. | |
| 2012/0006564 | A1 * | 1/2012 | Francis et al. | 166/377 |
| 2012/0160474 | A1 | 6/2012 | Holderman et al. | |

FOREIGN PATENT DOCUMENTS

SU 981569 A1 12/1982

OTHER PUBLICATIONS

International Search Report for International Application Serial No. PCT/US13/38475, issued Jun. 27, 2013.

* cited by examiner

*Primary Examiner* — Blake Michener

(74) *Attorney, Agent, or Firm* — Garvey, Smith, Nehrbass & North, L.L.C.; Gregory C. Smith; Julia M. FitzPatrick

(57) ABSTRACT

A hydraulic screen table having a base, an upper work surface, an opening in the screen table for allowing pipe to travel, upper support plates, emergency actuation plates, first and second set of powered cylinders wherein upon sensing an emergency, the cylinders pull the support plates and allow the sand screen to fall into the well bore.

18 Claims, 7 Drawing Sheets

HYDRAULIC SCREEN TABLE APPARATUS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus and method of the present invention relates to equipment for installing sections of sand screens into a well bore. More particularly, the present invention relates to a hydraulically powered screen table mountable on the rotary table which allows a length of sand screen to be released into the hole when there is an emergency on the oil rig.

2. General Background of the Invention

In the general operation of oil equipment, during the recovery of the hydrocarbons from the well, after hydrocarbons are found, one part of the process is to lower sections of pipe which are comprised of layers of screen material, known as sand screens, so that when the oil is brought up to the surface through the pipe, the oil is filtered through the screen and into the interior of the pipe in order to remove all of the sand impurities of the like from the oil. Of course, in order to place the sand screen down the bore hole of the oil well, sections of sand screen must be interconnected end to end, as with normal sections of pipe during the drilling or recovery of oil. This is accomplished by the use of a screen table.

A screen table is a device which is placed onto the rotary table above the opening in the rig floor. A section of sand screen is lowered through a central opening in the screen table, and into the well bore. The screen table includes a pair of opposing plates which engage the wall of the sand screen below the box end of the section of sand screen, which allows the sand screen to hang from the screen table by the large box end. While in place on the screen table a next section of sand screen is lowered onto the section in place and rotatably engaged to it. Once that is done, the screen table plates are manually pulled away from one another while the section of sand screen is held in place above the rig floor, and the next section of sand screen pipe is lowered and the process is repeated until sufficient number of sections of sand screen are in place down the borehole.

One of the problems in this operation is that during this placement of sand screens end to end, the weight of the entire length of sand screens down hole becomes extremely heavy. Therefore, when the plates are engaged against the wall of the sand screen, and the sand screen string is "hanging" in the well bore. Should there occur a problem down the hole such as a kick, the plates cannot be manually pulled away from the sand screen since the weight of the pipe does not allow the manual manipulation of the plates, and the sand screen string is not allowed to drop down into the borehole.

This could cause a serious problem, since normally, when a kick occurs, the blowout preventors below the rig floor are immediately closed so that any pressure from the kick remains within the bore hole and does not reach the rig.

However, because the sand screen sections are not rigid, since they are comprised of layers of soft filter material, the blowout preventors cannot sever the string, and may not be fully closed. If this should occur, the pressure will then reach the rig which could have catastrophic results. Therefore, to avoid this eventuality, it is imperative that the sand screen be allowed to be released from the screen table, and fall into the borehole to a level below the blowout preventor stack, so that the blowout preventors fully close and capture the kick downhole. Therefore, there is a need in the industry for a device which would allow the plates to be disengaged from the wall of the sand screen string so that the string of sand screens can be allowed to drop into the hole for the safety of the workers on the rig.

Applicant is submitting herewith an Information Disclosure Statement which includes the following patents which were found in the prior art.

The following U.S. Patents are incorporated herein by reference:

TABLE

| Pat. No. | TITLE | ISSUE DATE |
|---|---|---|
| 3,454,289 | Pipe Apparatus | Jul. 08, 1969 |
| 6,053,250 | Gravel Pack Apparatus | Apr. 25, 2000 |
| 6,598,685 | Drilling Fluid Screen and Method | Jul. 29, 2003 |
| 6,793,020 | Mechanical Torque Table and Method | Sep. 21, 2004 |
| 7,055,609 | Handling and Assembly Equipment and Method | Jun. 06, 2006 |
| 7,243,742 | Drill Pipe Screen | Jul. 17, 2007 |
| 2008/0236841 | Downhole Swivel Sub | Oct. 02, 2008 |
| 2011/0315369 | Apparatus and Method For Fluidically Coupling Tubular Sections and Tubular System Formed Thereby | Dec. 29, 2011 |

BRIEF SUMMARY OF THE INVENTION

The apparatus and method of the present invention solves the problems in the art in a simple and straightforward manner. What is provided is a hydraulic screen table apparatus, having a base for resting on a surface, such as a rotary table; an upper work surface, raised above the rotary table; an opening in the screen table for allowing a section of pipe, such as sand screen, to travel into and out of a well bore below the rotary table; and a pair of upper support plates, moveable between a closed position, engaging a wall of the section of sand screen, to an open position, allowing the sand screen to be lowered into a well bore; a pair of emergency plates, which are normally manually pinned to the pair of upper support plates when the upper support plates are in the closed position around the section of sand screen, and are stationary upon which the upper support plates travel during normal operations; first hydraulic cylinders securing the pair of upper plates to the pair of emergency plates; second hydraulic cylinders secured to the pair of emergency actuation plates; upon sensing an emergency down the bore hole, the first hydraulic cylinders removing the pin between the first and second plates; next, the second hydraulic cylinders moving the emergency actuation plates to the open position and pulling the upper plates from the closed position around the sand screen to an open position away from the sand screen, allowing the sand screen to fall into the well bore.

Therefore, it is the principal object of the present invention to provide a hydraulically powered screen table, which allows a heavy string of sand screen to be allowed to drop into the hole should there be a kick in the pressure downhole;

It is a further object of the present invention to provide a hydraulic screen table which allows for manual manipulation of the main actuation plates during standard operational procedure, and for allowing the actuation plates to be hydraulically disengaged from the sand screen string should there be an emergency situation on the rig so that the string can drop into the bore hole.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 2A, 2B:
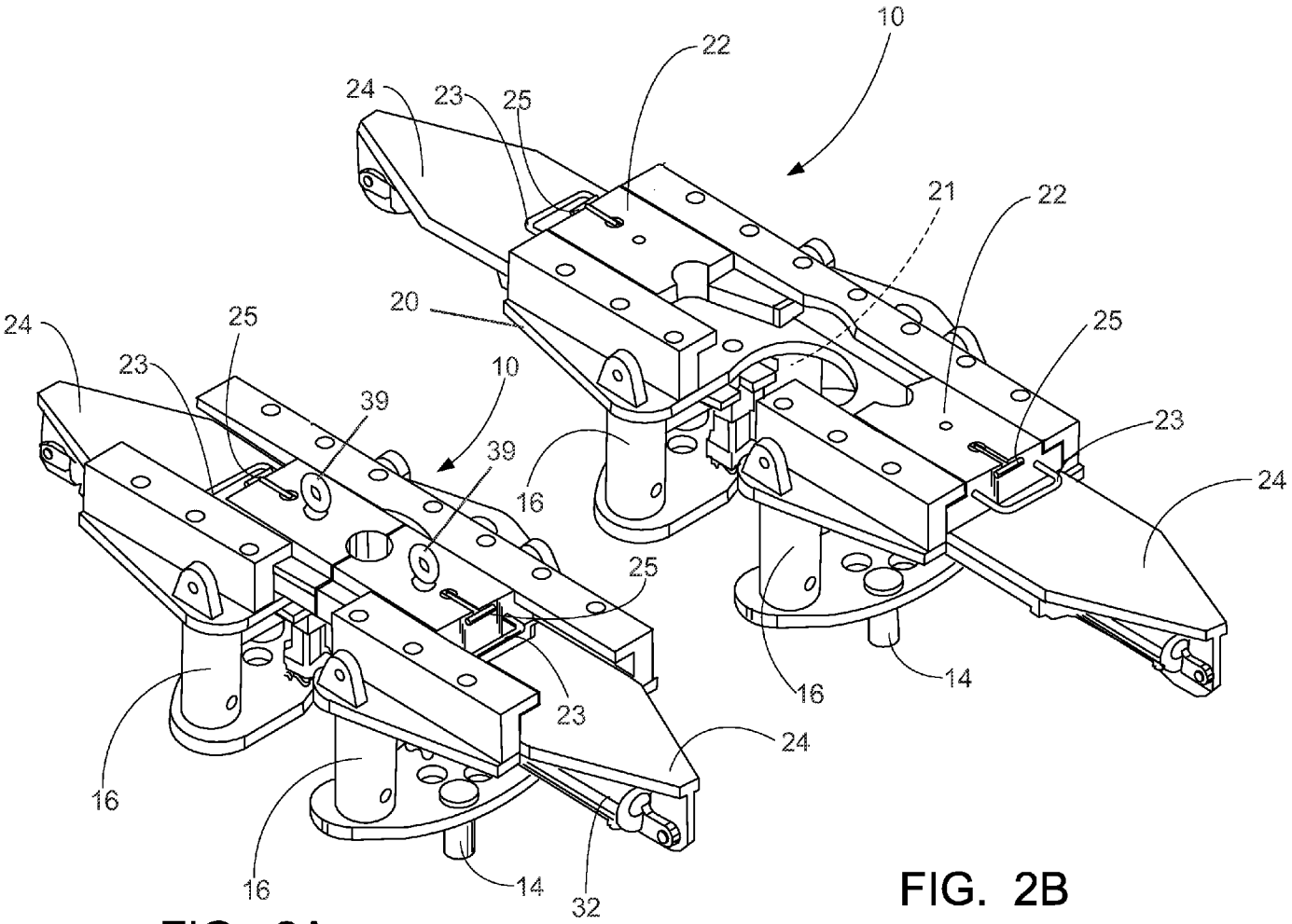
FIGS. 2A and 2B illustrate the emergency and main actuation plates in the closed and open position respectively.
Figure 3:
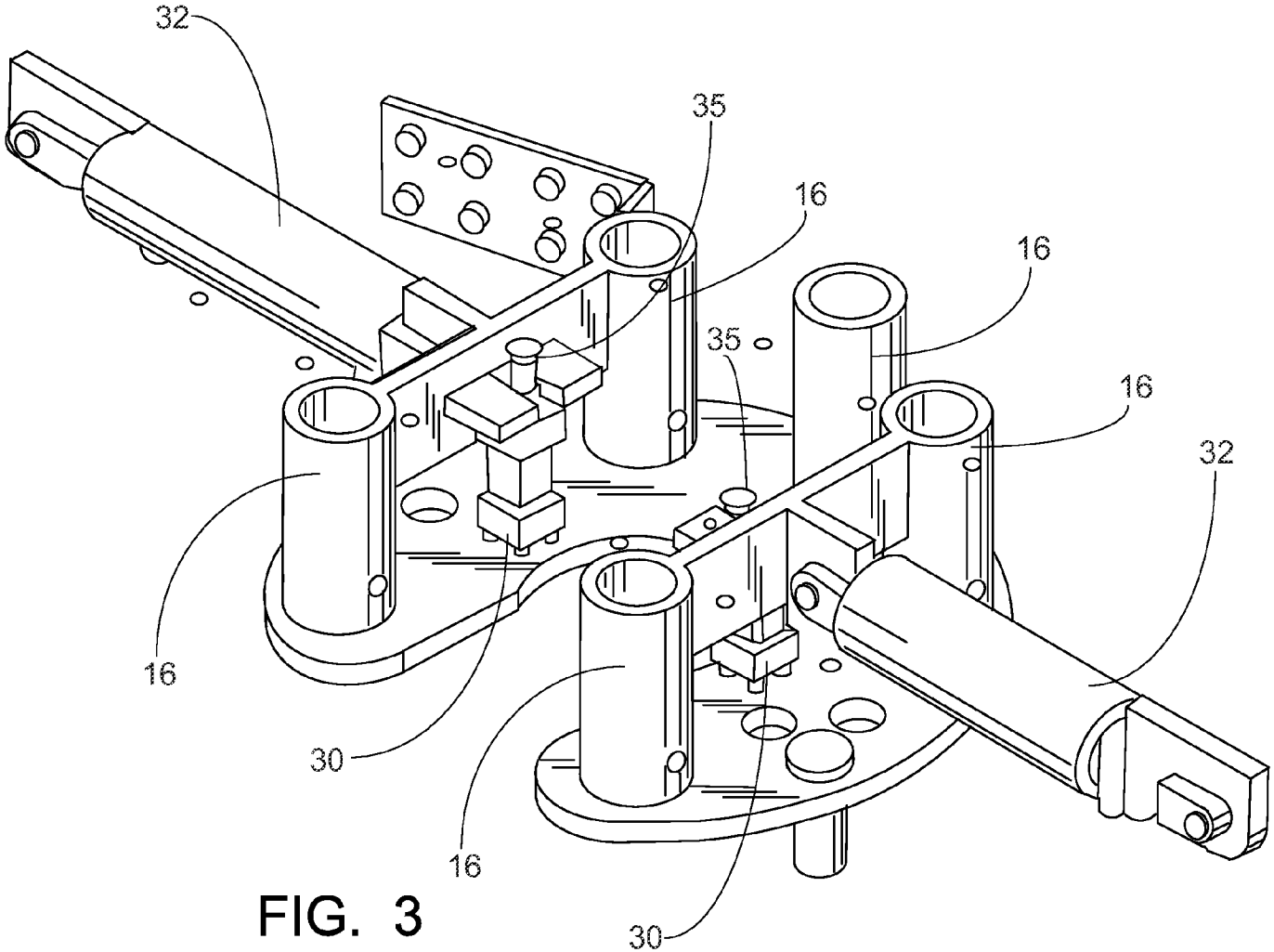
FIG. 3 illustrates the support members of the apparatus of the present invention.

FIGS. 1 through 5C illustrate the preferred embodiment of the apparatus of the present invention by the numeral 10. As seen in the overall view in FIG. 1, the hydraulic screen table apparatus 10, referred also as apparatus 10, includes a base portion 12, which includes a pair of plates 15 which are resting on the upper surface of the rotary table 13. The plates 15 are engaged to the rotary table 13 through multiple pegs 14 so that apparatus 10 is securely engaged to the rotary table 13 during operations. There is included a plurality of vertically inclined upper support base extension members 16, which provide a means for lifting the screen table apparatus 10 to a predetermined height above the floor of the rotary table 13, so that a worker is able to conduct work at the screen table apparatus 10 in a comfortable level, depending on the worker's height. As seen in FIG. 3, there is a first set of base extension members 16 extending upward from the rotary table 13, while in FIG. 1, there is provided a second upper level of base extension members 16 extending upward from a second level of plates 15, again for raising the work surface of the screen table 10 to a comfortable level. Thus multiple levels of extension members 16 may be utilized in order to place the screen table 10 at the desired operation height above the rotary table 13.

Figure 1:
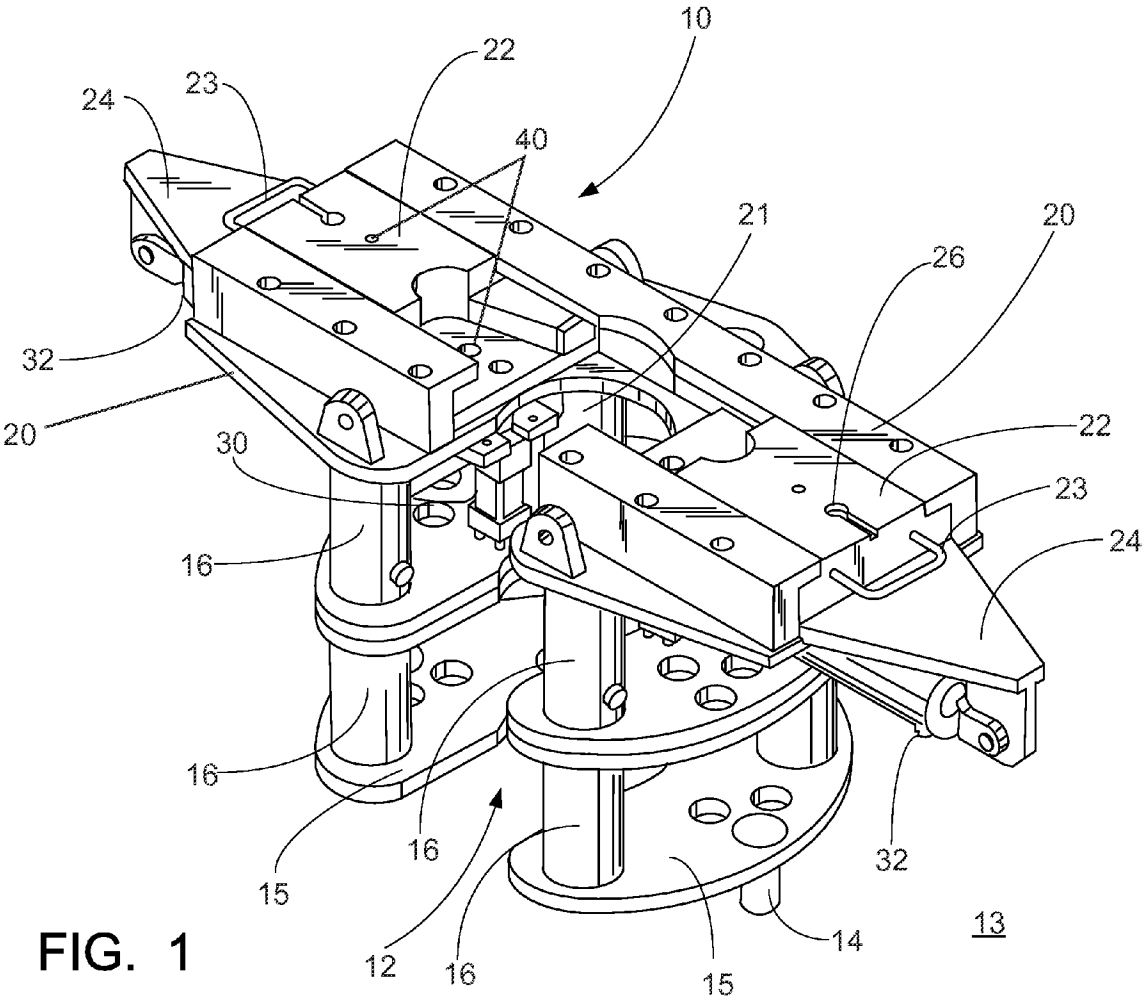
FIG. 1 illustrates the overall view of the screen table apparatus of the present invention.
Figure 4A:
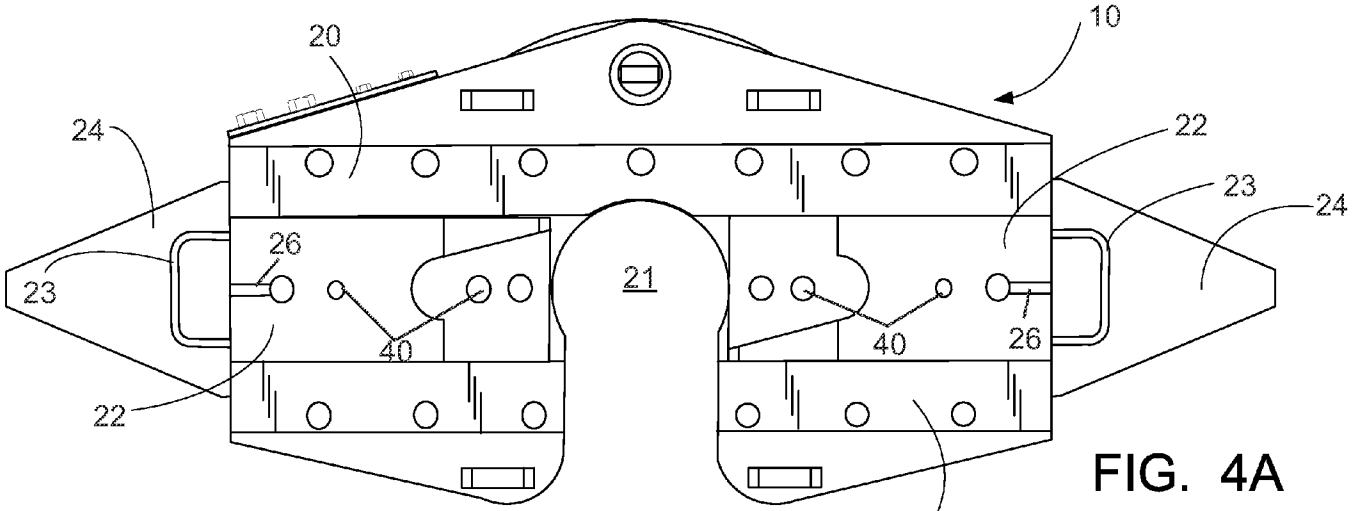
FIGS. 4A and 4B illustrate upper views of the main actuation plate moving from the open unlocked position to the closed locked position around a section of sand screen.
Figure 4B:
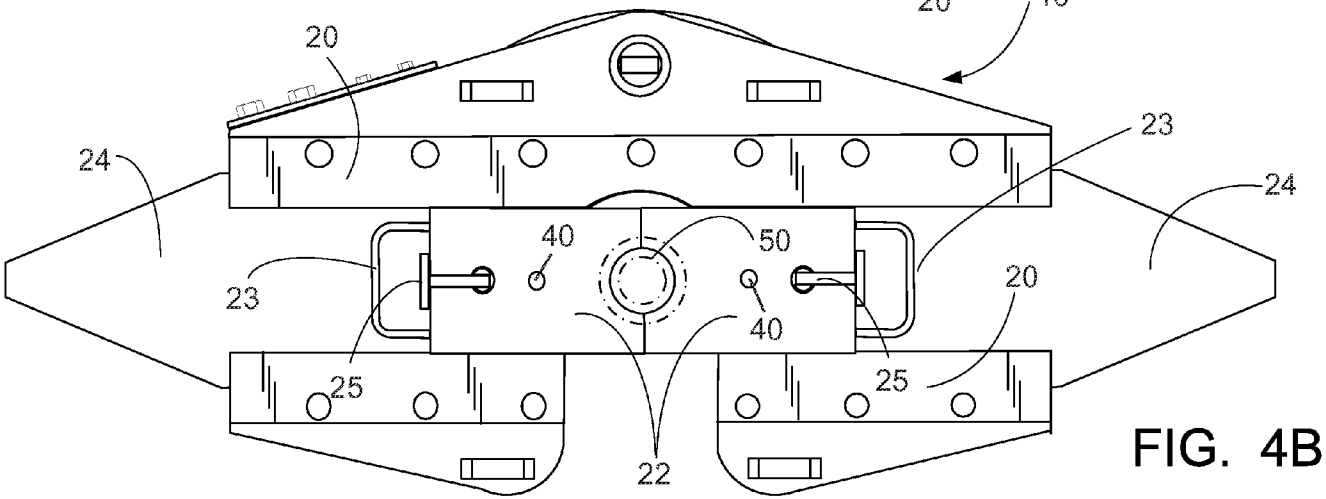

As seen in FIGS. 1, and 2A-2B, there is provided the principal work surface of the screen table apparatus 10. This is defined by a base platform 20 which rests on the upper ends of the support members 16, and serves as the principal table upon work on the table 10 is undertaken. The principal support base 20 includes a circular opening 21, which is centrally located so that when the table 10 is in place, the opening 21 is in direct line with the opening in the rotary table 13 so that sand screen 50 (See FIGS. 5A-5C) entering and exiting the rotary table 13 passes through the opening 21 in the screen table 10. The table 10 provides a pair of main upper support plates 22, which are slidably movable in a first open position, as seen in FIG. 4A, for receiving a length of sand screen therethrough, to a second closed position, as seen in FIG. 4B, for engaging around a section of sand screen 50 and securing it in place. Each of the upper support plates 22 include a slot 26 for receiving a pin 25 (see FIGS. 2B, 4A). Each of the upper support plates 22 also include a handle member 23 which allows a worker to pull the plates 22 between open and closed positions during the movement of the sand screens through the table 10, during normal operational procedures. The handles 23 allow the plates 22 to be pushed into the closed position around a length of sand screen 50, below the box portion 52 of the sand screen 50, where the sand screen 50 is held in place. As described earlier, this manual manipulation of the plates 22 is known in the art during normal makeup of a string of sand screen 10 that is being sent down hole.

Figure 5A:
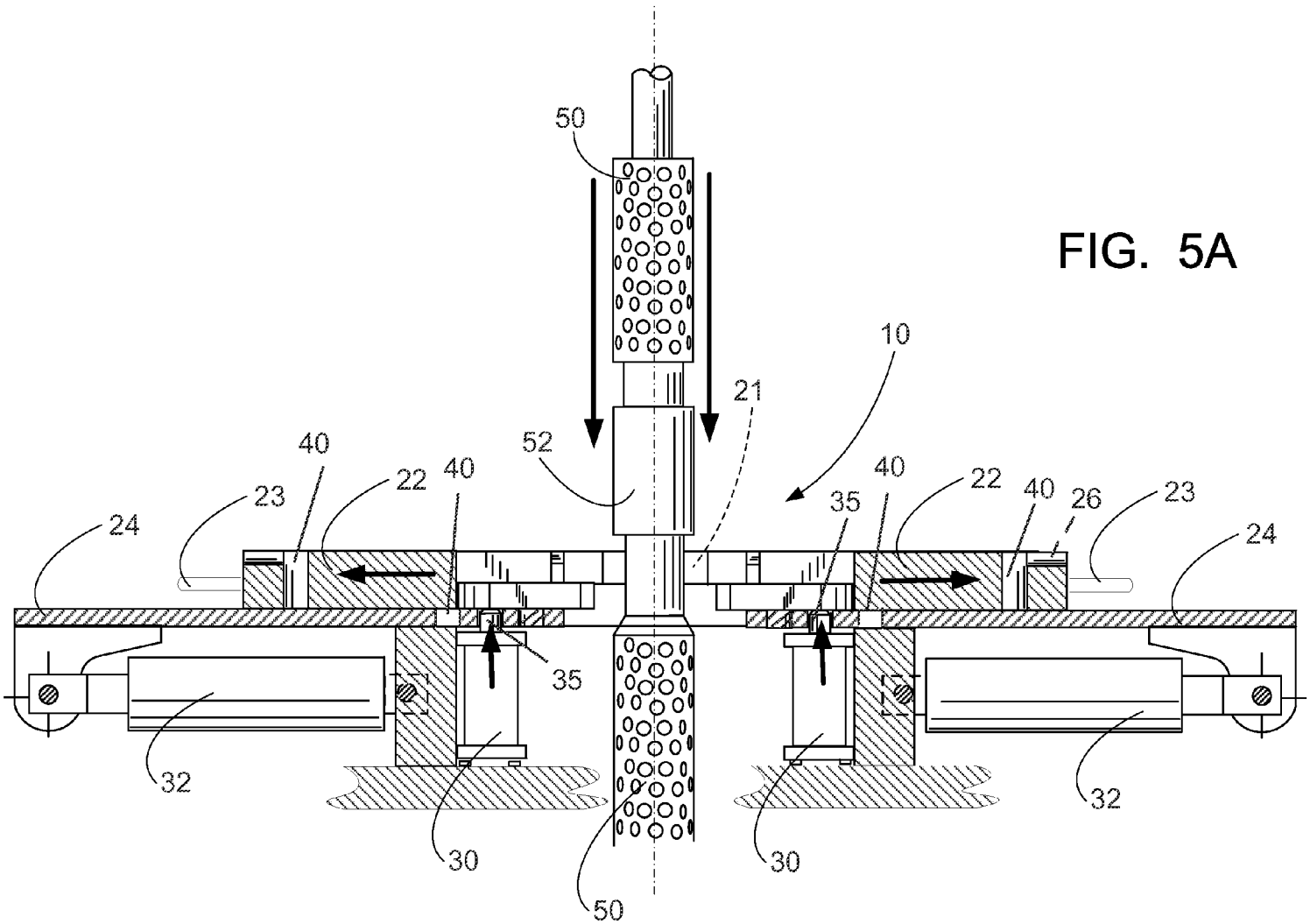
FIG. 5A shows a cross section view of a section of sand screen being placed down the bore hole with the main actuation plates open.
Figure 5B:
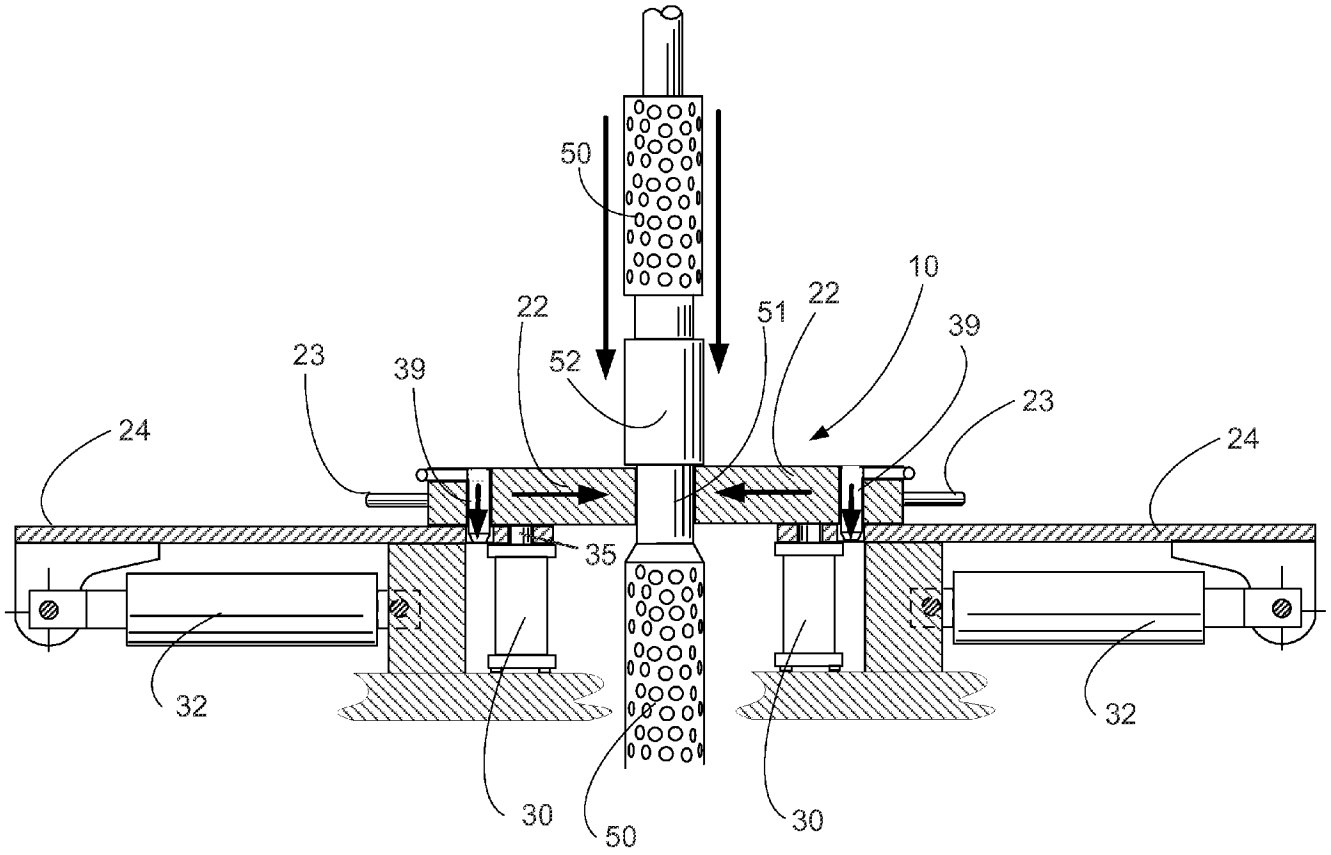
FIG. 5B illustrates in cross section view the section of sand screen held in place by the main actuation plates in the closed position.
Figure 5C:
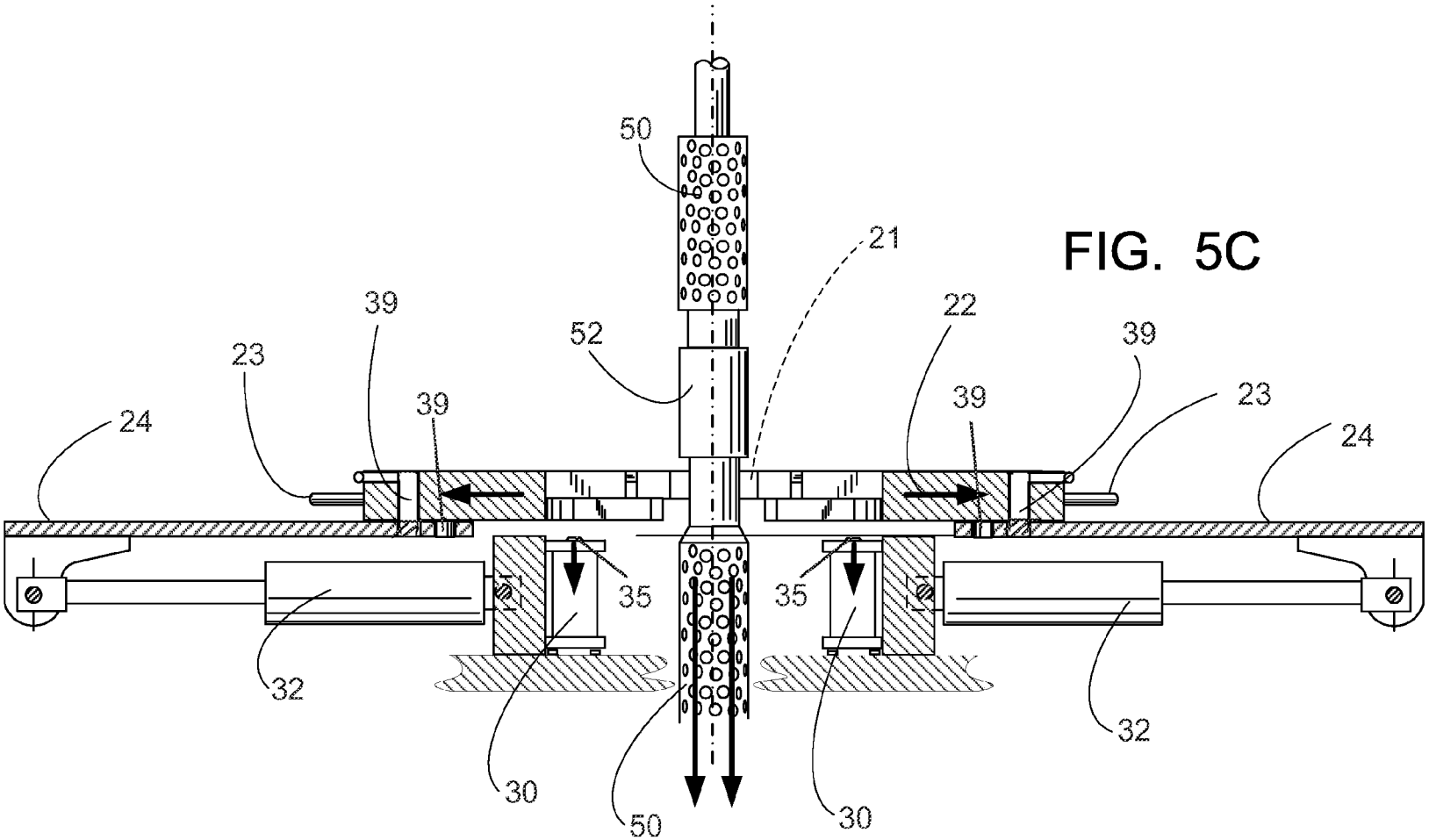
FIG. 5C illustrates the opening of the emergency actuation plates in the event of a kick so that the pipe is free from the manual plates and allowed to drop within the hole.

In the present invention, although the main support plates 22 are able to slide freely manually during operation, the table 10 of the present invention provides a set of lower plates, which are referred to as lower emergency actuation plates 24, which are immovable during normal operations and are held in place on the support 20. However, as seen in FIGS. 5A-5C, when the main support plates 22 are moved to the closed position around the sand screen 50, bores or openings 40 in the main support plate 22 and emergency actuation plates 24, line up with an opening in the principal support 20 (see FIG. 2), and the worker manually pins the main support plates 22, with a pin or bolt 39 which travels through the bore or opening 40 in the emergency actuation plates 24 and into the opening in the principal support 20. This is so that the main support plates 22, once in place around the sand screen 50, cannot inadvertently be pulled away without the pin or bolt 39 being manually pulled.

Turning now to the pair of emergency actuation plates 24 which were referred to earlier. During the normal operation of the table 10, the main support plates 22 are slid manually opened and closed since they are easy to handle with the section of sand screen 50 supported from above the rig floor. As seen in FIG. 4B, the main support plates 22 are in the closed position around a section of sand screen 50, and the sand screen 50 string is hanging from the main support plates 22, not supported by the rig. Should there be an emergency situation downhole, such as a kick, due to the excessive weight of the sand screen 50 string supported on the plates, the weight of the sand screen 50 string will not allow the main support plates 22 to be manually pulled away, so the sand screen 50 string can be allowed to drop into the bore hole.

Therefore, in order to solve this situation, there is provided the emergency actuation plates 24 as discussed earlier. As seen in overall view in FIG. 3, and in side view in FIG. 5B, the pair of emergency actuation plates 24 are engaged to a first pair of upright cylinders 30, each of which include a pin 35, which is normally pinned into each plate 24, to maintain the actuation plates 24 stationary and immovable during normal operations. FIG. 3 also clearly shows a second set of horizontally disposed cylinders 32 which are also pinned into emergency actuation plates 24, which when activated, the expansion of the cylinders 32 would move each of the emergency plates 24 from their normally closed position as seen in FIG. 5B to their open position, as seen in FIG. 5C. The reasons for this arrangement are explained below.

Operation of the Hydraulic Screen Table During Emergency

FIGS. 5A through 5C show clearly the method of the present invention, and the operation of the screen table 10 both during normal working circumstances and during an emergency. In FIG. 5A, the section of sand screen 50 is being lowered through the opening 21 in the table 10 after the upper plates 22 have been manually moved to the open position. In FIG. 5B, the main support plates 22 have been manually closed around the wall 51 of the sand screen 50 below the box end 52, so that another upper section of sand screen 50 can be threaded to the section held in place by main support plates 22. At this point the main support plates 22 are manually pinned through the stationary emergency plates 24, and into the main support base 20. This, as described earlier, is normal operation of the table 10.

However, an emergency may arise when there is a kick in the well, and the well threatens to blow out. As explained earlier, although the well has blowout preventors, because sand screen 50 string has a flexible wall for filtering sand, the blowout preventors may be unable to sever the screens 50, and therefore result in a well that has not been fully shut in by the preventors. Therefore, the wisest course of action is to allow the string of sand screen 50 to drop into the borehole, below the preventors, so that the well is securely shut in. However, as discussed earlier, if the entire string of sand screen 50 is hanging on the main support plates 22, these cannot be opened manually. Therefore, in this event, a first operator would power the first set of hydraulic cylinders 30 to withdraw the pins 35 from the emergency actuation plates 24, as seen in FIG. 5C. This would free the plates 24 to be able to be opened. Next, a second operator would power the second set of hydraulic cylinders 32 to open, and in doing so, pull the plates 24 outward from the closed to the open positions, as seen also in FIG. 5C. Since the upper main plates 22 are manually pinned closed by pins 39, as explained earlier, when the emergency plates 24 are moved to the open position by hydraulic cylinders 32, the manual pins 39 are sheared, and the main plates 22 are pulled open also as the emergency plates 24 are pulled open by the hydraulic cylinders 32.

When this is done, the upper plates 22, which are pinned into the emergency plates 24, by pins 39, would be pulled open against the weight of the sand screen 50 string, thus allowing the string to fall into the well bore. It should be noted that the emergency operation of the table 10 requires an operator for each set of cylinders 30, 32, to avoid the possibility of one operator from inadvertently activating both sets of cylinders 30, 32 during normal operations, which could result in a very dangerous situation for workers on the rig.

The following is a list of parts and materials suitable for use in the present invention:

PARTS LIST

| PART NUMBER | DESCRIPTION |
|---|---|
| 10 | screen table apparatus |
| 12 | base portion |
| 13 | rotary table |
| 14 | pegs |
| 15 | plates |
| 16 | base extension members |
| 20 | base platform/support |
| 21 | circular opening |
| 22 | main upper support plates |
| 23 | handle member |
| 24 | emergency actuation plates |
| 25 | pin |
| 26 | opening/slot |
| 30 | hydraulic cylinders |
| 32 | hydraulic cylinders |

-continued

| PART NUMBER | DESCRIPTION |
|---|---|
| 35 | locking pin |
| 39 | pin/bolt |
| 40 | bore or opening |
| 50 | sand screen |
| 51 | wall |
| 52 | box end |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A hydraulic screen table, comprising:

a. a base for resting on a surface;

b. a support portion raised above the surface;

c. an opening in the support portion for allowing a section of pipe to travel into and out of a well bore below the surface;

d. upper support plates moveable between a closed position, engaging a wall of the section of pipe, to an open position, allowing the pipe to be lowered into the well bore;

e. emergency actuation plates manually pinned to the upper support plates when the upper support plates are in the closed position around the section of pipe, and wherein said emergency actuation plates are stationary during normal operations and moveable to an open position during an emergency;

f. a first set of powered cylinders, each first powered cylinder comprising a movable locking pin, wherein when in an extended position each locking pin extends into one of the emergency actuation plates for holding the emergency actuation plates in place during normal operations, and wherein during an emergency, powering on the cylinders causes the locking pins to retract so that the emergency actuation plates are movable to an open position;

g. a second set of powered cylinders, each of the second set of powered cylinders secured to the emergency actuation plates, the second set of powered cylinders for moving the emergency actuation plates to an open position during an emergency, and pulling the upper support plates from the closed position around the sand screen to an open position away from the sand screen, allowing the sand screen to fall into the well bore.

2. The screen table in claim 1, wherein the first set of powered cylinders comprise hydraulic cylinders which are vertically disposed on the screen table.

3. The screen table in claim 2, wherein the second set of powered cylinders comprise hydraulic cylinders which are horizontally disposed on the screen table.

4. The screen table in claim 3, wherein the first set of cylinders are manually activated.

5. The screen table in claim 4, wherein the second set of cylinders are manually activated after the first set of cylinders is activated, the manual activation of the first and second set of cylinders being performed by different operators.

6. The screen table in claim 3, wherein the movement of the emergency actuation plates by the second set of hydraulic cylinders shears pins extending through the upper support plates and the emergency actuation plates.

7. The screen table in claim 1, wherein the base includes a pair of base plates and the support portion can be raised to a desired height through use of multiple base extension members between the base plates and the support portion.

8. The screen table in claim 1, wherein the upper plates are moved between open and closed positions around the sand screen manually during normal sand screen operations.

9. The screen table in claim 1, wherein the upper plates are moved by hydraulic cylinders to the open position, during an emergency, when a string of sand screen is supported by the upper plates due to the weight of the string of sand screen.

10. An improved screen table, having a base for resting on a rotary table; a support portion, raised above the rotary table; an opening in the support portion for allowing a section of sand screen to travel into and out of a well bore below the rotary table; and a pair of upper support plates, moveable between a closed position, engaging a wall of the section of sand screen, to an open position, allowing the sand screen to be lowered into the well bore, comprising:

a. a pair of emergency actuation plates, which are pinned with a first pair of pins to the pair of upper support plates when the upper support plates are in the closed position around the section of sand screen, the emergency actuation plates being stationary upon which the upper support plates travel during normal operations;

b. a first pair of hydraulic cylinders secured to the pair of emergency actuation plates, each of the hydraulic cylinders of the first pair comprising a locking pin extending through one of the emergency actuation plates to one of the upper support plates, the first pair of hydraulic cylinders for preventing movement of the emergency actuation plates during normal operations and for retracting the locking pins during an emergency to allow movement of the emergency actuation plates to an open position;

c. a second pair of hydraulic cylinders secured to the pair of emergency actuation plates;

d. upon sensing an emergency down the bore hole, means for activating the first pair of hydraulic cylinders to remove the locking pins from the emergency actuation plates;

e. next, second means for activating the second pair of hydraulic cylinders for moving the emergency actuation plates to the open position and pulling the upper support plates from the closed position around the sand screen to an open position away from the sand screen, allowing the sand screen to fall into the well bore.

11. A method of releasing a string of sand screen which is supported on a screen table during an emergency, the method comprising the following steps:

a. providing a screen table having a base for resting on a surface; an upper work surface, raised above the surface; an opening in the upper work surface for allowing a section of pipe, to travel into and out of a well bore below the surface;

b. moving a pair of upper support plates to engage a wall of the section of pipe and to support the pipe in the well bore;

c. mounting a pair of emergency actuation plates below the pair of upper support plates, and manually pinning each emergency actuation plate, via a pair of locking pins, to the pair of upper support plates when the upper support plates are in the closed position around the section of sand screen;

d. securing first hydraulic cylinders to the emergency actuation plates with a moveable pin extending from the hydraulic cylinder into the emergency actuation plates, for engaging the emergency actuation plates and preventing movement during normal operations;

e. securing second hydraulic cylinders to the pair of emergency actuation plates;

f. upon sensing an emergency down the well bore, activating the first hydraulic cylinders to retract the moveable pin and disengage the emergency actuation plates;

g. next, activating the second hydraulic cylinders for moving the emergency actuation plates to an open position and pulling the upper plates from the closed position around the sand screen to an open position away from the sand screen, allowing the sand screen to fall into the well bore below a level where blowout preventors are present.

12. The method in claim 11, wherein the first hydraulic cylinders are manually activated.

13. The method in claim 12, wherein the the second hydraulic cylinders are manually activated after the first hydraulic cylinders are activated, the manual activation of the first and second hydraulic cylinders being performed by different operators.

14. The method in claim 11, wherein the base includes a pair of base plates and further comprising the step of raising the upper work surface to a desired height through the use of multiple base extension members between the base plates and the upper work surface.

15. The method in claim 11, further comprising the step of manually moving the upper plates between open and closed positions around the sand screen during normal sand screen operations, wherein the pair of locking pins in step "c" are manually removed to move the upper plates to an open position and inserted when the upper plates are moved to the closed position.

16. The method in claim 11, wherein the moving of the emergency actuation plates by the second hydraulic cylinders to the open position when a string of sand screen is supported by the upper plates is due to the weight of the string of sand screen.

17. The method in claim 11, wherein the movement of the emergency actuation plates by the second set of hydraulic cylinders shears each pin of the pair of locking pins.

18. A screen table having a base for resting on a rotary table; an upper support portion raised above the rotary table; an opening in the upper support portion for allowing a section of sand screen, to travel into and out of a well bore below the rotary table; the screen table further comprising:

a. a pair of upper support plates, moveable between an open position to a closed position, engaging a wall of the section of sand screen, as the sand screen is hanging in the well bore;

b. a set of emergency actuation plates in a stationary position during normal operations, upon which the upper support plates travel during connection of the sections of sand screen; and c. a hydraulic cylinder secured to each of the emergency actuation plates for moving the emergency actuation plates away from the sand screen in an emergency, wherein movement of the emergency actuation plates causes movement of the upper support plates away from the sand screen, to release the sand screen and allow it to fall into the well bore at least to a level below blowout preventors.

* * * * *